US011660854B2

(12) United States Patent
Kim et al.

(10) Patent No.: US 11,660,854 B2
(45) Date of Patent: May 30, 2023

(54) CONTINUOUS SUBLIMATION TRANSFER METHOD USING A VACUUM SUCTION ROLLER

(71) Applicant: DUKSUNG CO., LTD, Gyeonggi-do (KR)

(72) Inventors: Sung Jin Kim, Incheon (KR); Young Chul Lee, Gyeonggi-do (KR)

(73) Assignee: DUKSUNG CO., LTD, Gyeonggi-do (KR)

( * ) Notice: Subject to any disclaimer, the term of this patent is extended or adjusted under 35 U.S.C. 154(b) by 0 days.

(21) Appl. No.: 17/856,924

(22) Filed: Jul. 1, 2022

(65) Prior Publication Data

US 2023/0031339 A1 Feb. 2, 2023

Related U.S. Application Data

(63) Continuation-in-part of application No. 17/493,193, filed on Oct. 4, 2021, now abandoned.

(30) Foreign Application Priority Data

Jul. 30, 2021 (KR) ..... 10-2021-0100693

(51) Int. Cl.

| | |
|---|---|
| ***B41F 16/02*** | (2006.01) |
| ***B41J 13/22*** | (2006.01) |
| ***B41J 11/00*** | (2006.01) |

(52) U.S. Cl.

CPC ..... *B41F 16/02* (2013.01); *B41J 11/0085* (2013.01); *B41J 13/226* (2013.01)

(58) Field of Classification Search

None

See application file for complete search history.

(56) References Cited

U.S. PATENT DOCUMENTS

| | | | | |
|---|---|---|---|---|
| 3,768,280 | A | 10/1973 | Kannegiesser et al. | |
| 4,056,352 | A * | 11/1977 | Mayer | B41M 5/0358 68/5 D |
| 4,116,022 | A * | 9/1978 | Lopata | B41F 16/02 68/5 D |
| 4,178,782 | A | 12/1979 | Schiffer | |
| 2005/0139096 | A1 | 6/2005 | Lu et al. | |

FOREIGN PATENT DOCUMENTS

| | | | |
|---|---|---|---|
| CH | 569141 | B5 | 11/1975 |
| CN | 2365056 | Y | 2/2000 |
| CN | 1417026 | A | 5/2003 |

(Continued)

OTHER PUBLICATIONS

English language machine translation of DE 2250840 A1, publication date May 2, 1974. (Year: 1974).*

(Continued)

*Primary Examiner* — Leslie J Evanisko

(74) *Attorney, Agent, or Firm* — Christensen, Fonder, Dardi & Herbert PLLC; Diane E. Bennett; Peter S. Dardi

(57) ABSTRACT

The present invention relates to a continuous printing apparatus using a vacuum suction roller, and it is to provide a continuous printing apparatus and method using a vacuum suction roller capable of reducing costs and improving productivity by continuously printing on the surface of a woven fabric using the vacuum suction roller.

9 Claims, 3 Drawing Sheets

(56) References Cited

FOREIGN PATENT DOCUMENTS

| | | | | |
|---|---|---|---|---|
| CN | 203510935 | U | | 4/2014 |
| DE | 2005186 | A | | 8/1971 |
| DE | 2061026 | A | | 7/1972 |
| DE | 2250940 | A | | 5/1974 |
| DE | 2438723 | A1 | | 3/1975 |
| FR | 2079256 | A1 | | 11/1971 |
| GB | 146388 | A | | 2/1977 |
| JP | H05-295669 | A | | 11/1993 |
| JP | 10331080 | A | * | 12/1998 |
| JP | 2001-329474 | A | | 11/2001 |
| JP | 2011051782 | A | * | 3/2011 |
| JP | 2016108697 | A | * | 6/2016 |
| JP | 2018-51923 | A | | 5/2018 |
| KR | 10-2002-0095144 | A | | 12/2002 |
| KR | 10-2005-0071463 | A | | 7/2005 |
| KR | 10-2012-0009745 | A | | 2/2012 |
| KR | 10-1135531 | B1 | | 4/2012 |
| KR | 10-2012-0073048 | A | | 7/2012 |
| KR | 10-2017-0078183 | A | | 7/2017 |

OTHER PUBLICATIONS

English language machine translation of JP 2016-108697 A, publication date Jun. 20, 2016. (Year: 2016).*

English language machine translation of JP 10-331080 A, publication date Dec. 15, 1998. (Year: 1998).*

English language machine translation of JP 2011-051782 A, publication date Mar. 17, 2011. (Year: 2011).*

Office Action for corresponding Korean Patent Application No. 10-2021-0100693 dated Sep. 17, 2021.

Office Action for corresponding German Patent Application No. 10-2021-124-267.8 dated Jan. 19, 2022.

Office Action from corresponding Chinese Patent Application No. 202210762519.8 dated Feb. 15, 2023.

Office Action for corresponding German Patent Application No. 10 2022 117 792.0 dated Dec. 1, 2022.

* cited by examiner

CONTINUOUS SUBLIMATION TRANSFER METHOD USING A VACUUM SUCTION ROLLER

CROSS REFERENCE TO RELATED APPLICATIONS

This application is a continuation-in-part of co-pending U.S. patent application Ser. No. 17/493,193 filed on Oct. 4, 2021 to Kim et al., entitled "Continuous Printing Apparatus Using Vacuum Suction Roller and Method Thereof", which claims the benefit of priority to Korean Patent Application No. 10-2021-0100693, filed on Jul. 30, 2021, both of which are incorporated herein by reference.

TECHNICAL FIELD

The present invention relates to a continuous printing apparatus using a vacuum suction roller and a method thereof, which achieve cost saving and productivity improvement by continuously printing on the surface of a woven fabric using the vacuum suction roller.

BACKGROUND ART

In general, a dyeing method of fabrics comprises dyeing a woven fabric by introducing it in a dye solution. However, this method generates a large amount of wastewater, which causes environmental pollution, and has problems in complicated process and poor workability.

In addition, in the case of partial dyeing, it is necessary to correspond to color pattern through individual yarn dyeing before weaving, and there is a limitation in that a yarn having a desired color must be prepared. As a method of improving the above problems, there is a sublimation transfer method.

The sublimation transfer method may be to print with salts by applying heat and pressure in a state in which the printed sublimation transfer film is laminated on the surface of the woven fabric. In the general sublimation transfer method, there was a difficulty in mass production because the structure of the jig or the way of working were not suitable for continuous production.

Accordingly, there is a need for a technology capable of solving the above-described problems, which is environmentally friendly and capable of reducing costs and improving productivity.

DETAILED DESCRIPTION OF THE INVENTION

Technical Problem

The present invention relates to a continuous printing apparatus using a vacuum suction roller, and more particularly to a continuous printing apparatus using a vacuum suction roller and a method thereof which is capable of reducing costs and improving productivity by continuously printing on the surface of a woven fabric using the vacuum suction roller.

The technical problems to be solved by the present invention are not limited to the technical problems mentioned above, and other technical problems not mentioned will be clearly understood by those of ordinary skill in the art to which the present invention pertains from the following description.

Solution to Problem

A continuous printing apparatus using a vacuum suction roller of the present invention may comprise:

a first unwinding roller for unwinding an air permeable fabric to be printed;

a second unwinding roller for unwinding a printing film coated with dye on one side surface;

a first heating unit for preheating the air permeable fabric unwound from the first unwinding roller;

a vacuum suction roller configured so that while the printing film is laminated on one side surface of the air permeable fabric that has passed through the first heating unit the other side surface of the air permeable fabric is in contact with one side of the roller;

a second heating unit positioned to be spaced from the surface of the vacuum suction roller in contact with the air permeable fabric at a certain interval to heat the air permeable fabric and the printing film;

a first recovery roller for recovering the air permeable fabric that has passed through the vacuum suction roller; and a second recovery roller for recovering the printing film that passed through the vacuum suction roller.

In the continuous printing apparatus using the vacuum suction roller of the present invention, the lateral surface of the vacuum suction roller in contact with the air permeable fabric is formed of an air permeable porous material having a plurality of pores, and the gas containing the sublimated dye on the surface of the vacuum roller may be sucked into the vacuum suction roller through the plurality of pores to bring the printing film into close contact with the air permeable fabric.

In the continuous printing apparatus using the vacuum suction roller of the present invention, the air permeable material having the plurality of pores and forming the lateral surface of the vacuum suction roller in contact with the air permeable fabric may be selected from porous SUS, ceramic and gypsum.

In the continuous printing apparatus using the vacuum suction roller of the present invention, the air permeable fabric may be a knitted fabric or a woven fabric manufactured by a weaving method.

In the continuous printing apparatus using the vacuum suction roller of the present invention, the first heating unit may be to preheat the air permeable fabric to a temperature of 100° C. to 200° C.

In the continuous printing apparatus using the vacuum suction roller of the present invention, the material of the printing film may be selected from PET, A-PET, PP, PE and paper.

In the continuous printing apparatus using the vacuum suction roller of the present invention, the second heating unit may be to heat the air permeable fabric and the printing film to a temperature of 130° C. to 250° C.

The continuous printing apparatus using the vacuum suction roller of the present invention may further comprise a cooling roller for cooling the air permeable fabric by contacting one side of the roller with the air permeable fabric between the vacuum suction roller and the first recovery roller.

In the continuous printing apparatus using the vacuum suction roller of the present invention, the vacuum suction roller may comprise an inner cylinder having a cylindrical shape, an outer cylinder whose inner circumferential surface is formed to be spaced apart from an outer circumferential surface of the inner cylinder, and a porous layer covering the outer circumferential surface of the outer cylinder, the outer circumferential surface of the inner cylinder and the inner circumferential surface of the outer cylinder may be spaced apart from each other to provide a vacuum forming space, the outer cylinder may be provided with a plurality of suction holes, the sublimated dye gas located outside the outer cylinder may be sucked into the vacuum forming space through the plurality of suction holes after passing through the porous layer.

In the continuous printing apparatus using the vacuum suction roller of the present invention, the vacuum forming space may be separated into a plurality of spaces by a plurality of partition walls, and each space of the vacuum forming space separated by the partition walls may be provided with a cooling flow path.

The continuous printing method using the continuous printing apparatus using the vacuum suction roller of the present invention may comprise:

a fabric preparation and preheating step of unwinding the air permeable fabric from the first unwinding roller and then preheating it through the first heating unit;

a printing film arrangement step of unwinding the printing film from the second unwinding roller and then laminating it on one side surface of the air permeable fabric;

a dyeing step using the vacuum suction roller of passing the air permeable fabric through the vacuum suction roller to bring the other side surface of the air permeable fabric into contact with one side of the vacuum suction roller;

a printing film separation step of separating the printing film from the air permeable fabric; and a dyed fabric cooling step of cooling the air permeable fabric by the cooling roller.

In the dyeing step using the vacuum suction roller of the continuous printing method of the present invention, the air permeable fabric in close contact with the vacuum suction roller may be heated by the second heating unit.

Effect of the Invention

The continuous printing apparatus and method using the vacuum suction roller of the present invention may exclude the use of a dyeing solution, thereby preventing the generation of wastewater and enabling an eco-friendly production process.

The continuous printing apparatus and method using the vacuum suction roller of the present invention enables mass-production through continuous production, thereby contributing to cost reduction.

The continuous printing apparatus and method using the vacuum suction roller of the present invention can produce high-quality fabrics with stable dyeing.

BEST MODE FOR CARRYING OUT THE INVENTION

Figure 1:
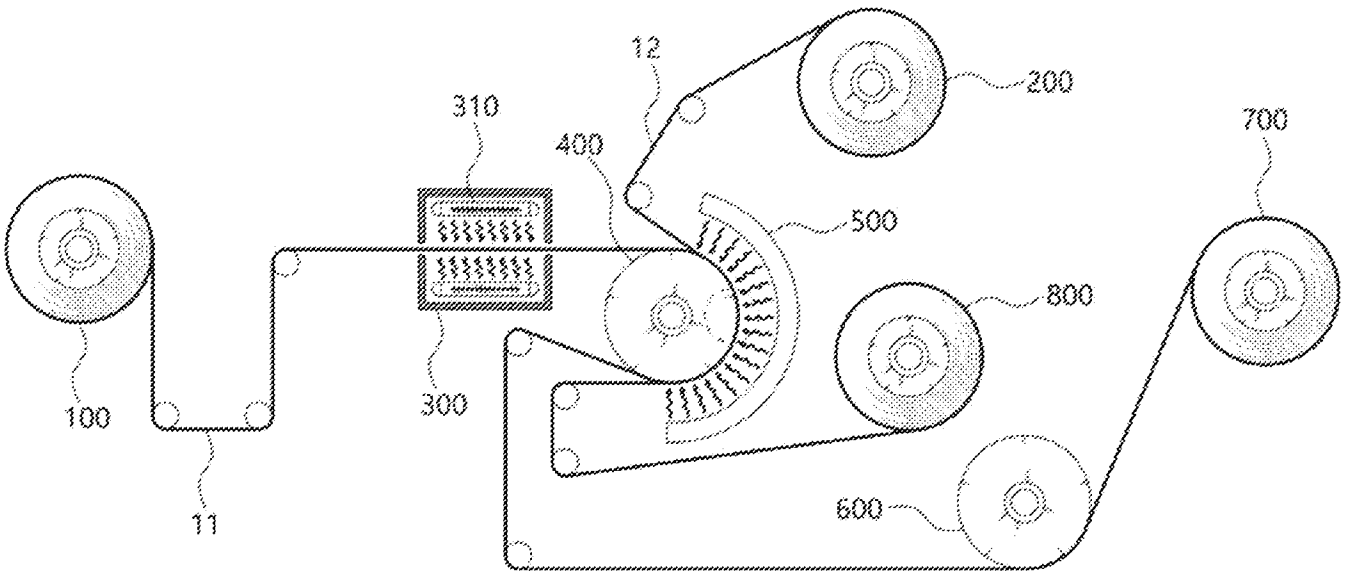
FIG. 1 is a conceptual diagram showing a continuous printing apparatus using a vacuum suction roller of the present invention.

Hereinafter, embodiments according to the present invention will be described in detail with reference to the accompanying drawings. The size or shape of the components shown in the drawings may be exaggerated for clarity and convenience of explanation. In addition, terms specially defined in consideration of the configuration and action of the present invention may vary depending on the intention or custom of the user or operator. Definition of these terms should be made based on the content throughout this specification.

In the description of the present invention, it should be noted that the orientation or positional relationship indicated by the terms "center", "top", "bottom", "left", "right", "vertical", "horizontal", "inside", "outside", "one side", "other side", etc. is based on the orientation or positional relationship shown in the drawings or the orientation or positional relationship that is usually arranged when using the product of the present invention, and it is only for the description and brief description of the present invention and is not intended to be construed as limiting the present invention because it does not suggest or imply that the indicated apparatus or device necessarily has the specified orientation and must be configured or operated in the specified orientation.

Figure 2:
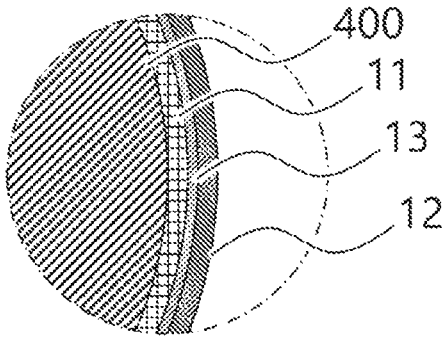
FIG. 2 is an enlarged cross-sectional view of an area of the dash-dotted line of FIG. 1.
Figure 3A:
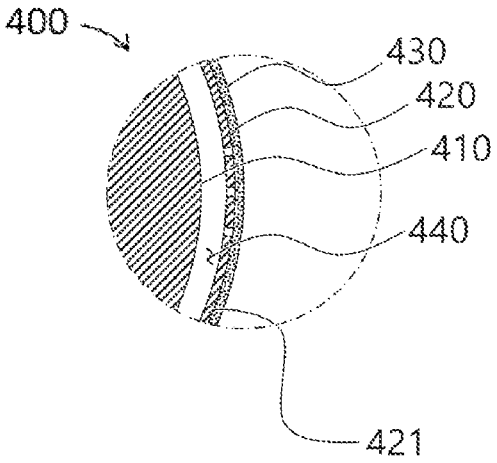
FIG. 3A is a cross-sectional diagram showing the vacuum suction roller.
Figure 3B:
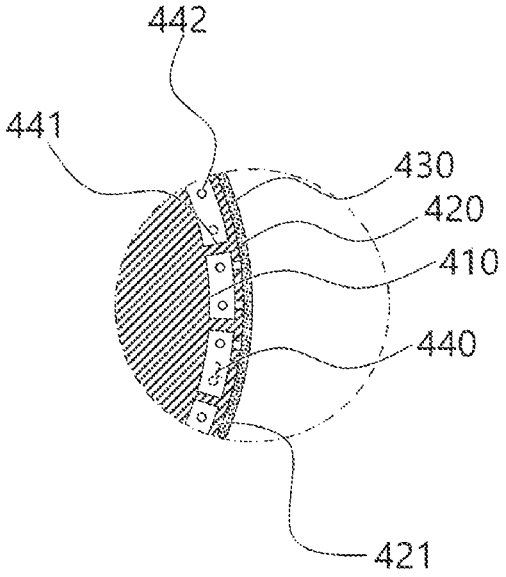
FIG. 3B is a cross-sectional diagram showing the vacuum suction roller of another embodiment.
Figure 4:
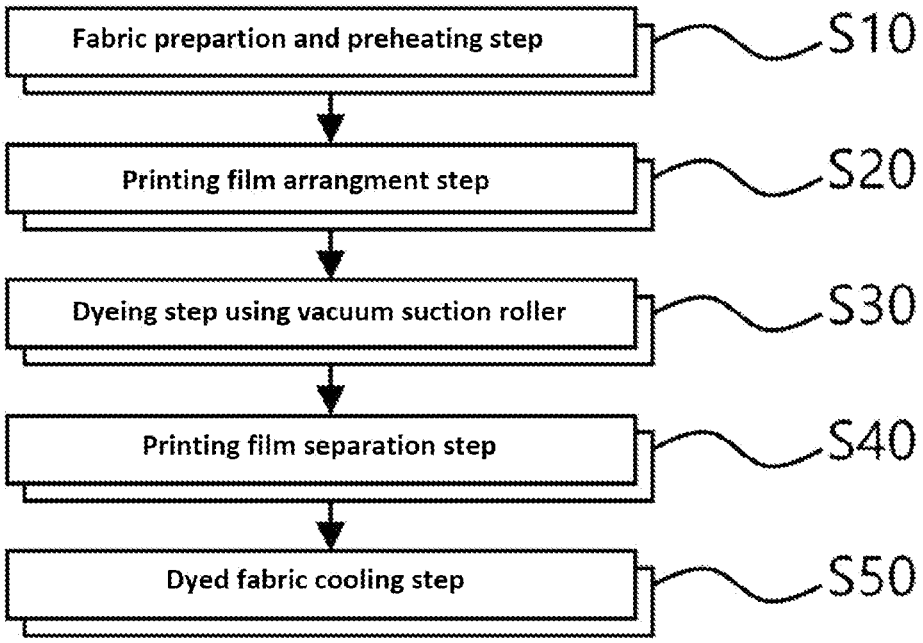
FIG. 4 is a block diagram showing the continuous printing method of the present invention.

FIG. 1 is a conceptual diagram showing a continuous printing apparatus using a vacuum suction roller of the present invention. FIG. 2 is an enlarged cross-sectional view of an area of the dash-dotted line of FIG. 1. FIG. 3A is a cross-sectional diagram showing the vacuum suction roller. FIG. 3B is a cross-sectional diagram showing the vacuum suction roller according to another embodiment. FIG. 4 is a block diagram showing the continuous printing method of the present invention.

The continuous printing apparatus using the vacuum suction roller of the present invention may be to print dyes on the air permeable fabric 11 which is air permeable on both sides. In the continuous printing apparatus using the vacuum suction roller of the present invention, a sublimation transfer film that can be used for various purposes may be used as the printing film 12, and the dye of the sublimation transfer film may be transferred to the air permeable fabric 11 by bringing the sublimation transfer film into close contact with the air permeable fabric 11 using the vacuum suction roller 400.

As shown in FIG. 1, the continuous printing apparatus using the vacuum suction roller of the present invention may comprise:

a first unwinding roller 100 for unwinding an air permeable fabric 11 to be printed;

a second unwinding roller 200 for unwinding a printing film 12 coated with dye on one side surface;

a first heating unit 300 for preheating the air permeable fabric 11 unwound from the first unwinding roller 100;

a vacuum suction roller 400 configured so that while the printing film 12 is laminated on one side surface of the air permeable fabric 11 that has passed through the first heating unit 300 the other side surface of the air permeable fabric 11 is in contact with one side of the roller;

a second heating unit 500 positioned to be spaced from the surface of the vacuum suction roller 400 in contact with the air permeable fabric 11 at a certain interval to heat the air permeable fabric 11 and the printing film 12;

a first recovery roller 700 for recovering the air permeable fabric 11 that has passed through the vacuum suction roller 400; and a second recovery roller 800 for recovering the printing film 12 that passed through the vacuum suction roller 400.

The air permeable fabric 11 may be printed. The air permeable fabric 11 is made of an air permeable material, and may be applicable without limitation to the material that is air permeable between one side surface to which the dye is transferred and the other side surface.

For example, the air permeable fabric 11 may be a knitted fabric or a woven fabric manufactured by a weaving method. There is no limitation on the weaving pattern of the air permeable fabric 11, and one side surface of the air permeable fabric 11 to which dye is transferred may be applicable without limitation among flat surfaces or three-dimensional surfaces provided with protrusions and concave portions.

The air permeable fabric 11 may be prepared with being wound around the cylindrical first unwinding roller 100.

Before the printing film 12 is laminated on one side surface of the air permeable fabric 11, the air permeable fabric 11 may be preheated through the first heating unit 300.

The first heating unit 300 may be preheated to a temperature at which the air permeable fabric 11 is not deformed or damaged by heat. For example, the first heating unit 300 may be to preheat the air permeable fabric 11 to a temperature of 100° C. to 200° C.

The first heating unit 300 is provided in the form of a chamber having a heating means 310 therein, and the air permeable fabric 11 may be preheated while passing through the first heating unit 300. The heating means 310 may be an IR heater.

The printing film 12 may be a sublimation transfer film. A dye id applied to one side surface of the printing film 12, and the dye of the printing film 12 may be transferred to one side surface of the air permeable fabric 11 by heat and pressure. The printing film 12 may be laminated on the preheated air permeable fabric 11 so that one side surface of the printing film 12 coated with dye faces one side surface of the air permeable fabric 11. The printing film 12 may be printed (applied) in a predetermined pattern or color.

The material of the printing film 12 may be selected from PET, A-PET, PP, PE and paper. The printing film 12 is made of a non-air-permeable material and may be compressed on the surface of the vacuum suction roller 400 with the air permeable fabric 11 therebetween by the suction force of the vacuum suction roller 400.

The material of the printing film 12 is determined in consideration of the weaving pattern of the air permeable fabric 11. For example, when the surface of the air permeable fabric 11 is formed as a three-dimensional surface, the printing film 12 may be preferably made of a thermoplastic film such as A-PET.

The printing film 12 may be prepared while being wound around the cylindrical second unwinding roller 200.

The vacuum suction roller 400 is provided in a cylindrical shape and the lateral surface may be in contact with the air permeable fabric 11 having the printing film laminated. Specifically, as shown in FIG. 2, while the air permeable fabric 11 and the printing film 12 are laminated so that one side surface of the air permeable fabric 11 is in contact with one side surface of the printing film 12 coated with dye 13, the other side surface of the air permeable fabric 11 may be in close contact with the surface of the vacuum suction roller 400.

A plurality of pores is formed on the lateral surface of the vacuum suction roller 400 in contact with the breathable fabric 11, and the gas containing the sublimated dye on the surface of the vacuum suction roller 400 is sucked into the vacuum suction roller 400 through the plurality of pores to bring the printing film 12 into close contact with the air permeable fabric 11. Specifically, the dye of the printing film 12 is sublimated by the second heating unit 500, which will be described later, and then the sublimated gaseous dye is guided into the pores by the negative pressure formed inside the vacuum suction roller 400. In the process, the dye may be stably adsorbed to the air permeable fabric 11.

The air permeable material having the plurality of pores and forming the lateral surface of the vacuum suction roller 400 in contact with the air permeable fabric 11 may be selected form porous SUS, ceramic and gypsum. The air permeable material having the plurality of pores and forming the lateral surface of the vacuum suction roller 400 in contact with the air permeable fabric 11 is not limited thereto, and any air permeable material having heat resistance capable of withstanding the heat emitted from the second heating unit 500 may be used without limitation.

The vacuum suction roller 400 is formed of a cylindrical cylinder that is air permeable inside and outside, and the cylindrical cylinder is provided with suction holes or has a porous structure, so that there is air permeable inside and outside. When a vacuum is applied inside the cylindrical cylinder, the gas on the surface of the cylindrical cylinder is sucked into the cylinder, thereby adsorbing the air permeable fabric 11 and the printing film 12 on the surface.

Specifically, as shown in FIG. 3A, the vacuum suction roller 400 may comprise an inner cylinder having a cylindrical shape 410, an outer cylinder 420 whose inner circumferential surface is formed to be spaced apart from an outer circumferential surface of the inner cylinder 410, and a porous layer 430 covering the outer circumferential surface of the outer cylinder 420.

The central axis of the inner cylinder 410 may be a rotation axis. The outer cylinder 420 is also provided in a cylindrical shape, and the outer cylinder 420 may be provided with a plurality of suction holes 421. The external gas of the outer cylinder 420 may be sucked into the outer cylinder 420 through suction holes 421. Specifically, the outer circumferential surface of the inner cylinder 410 and the inner circumferential surface of the outer cylinder 420 may be spaced apart from each other to provide a vacuum forming space 440, and the sublimated dye gas located outside the outer cylinder 420 may be sucked into the vacuum forming space 440 through the hole 421 after passing through the porous layer.

At this time, in order to prevent the negative pressure from being concentrated at the suction hole 421 on the outer circumferential surface of the outer cylinder 420, the outer circumferential surface of the outer cylinder 420 may be covered with an air permeable porous layer 430. By providing the porous layer 430, the entire surface of the vacuum suction roller 400 may have a constant air permeability.

The porous layer 430 may be formed to a thickness of 5 mm to 15 mm More preferably, the porous layer 430 may be formed to a thickness of 7 mm to 12 mm. The difference in air permeability for each portion of the porous layer 430 may be 1 cfm to 10 cfm. More preferably, the difference in air permeability for each portion of the porous layer 430 may be 2 cfm to 3 cfm. For example, the porous layer 430 between the vacuum forming space 440 and the outer space of the outer cylinder 420 may be formed to have the air permeability of 1 cfm to 10 cfm.

The porous layer 430 may be at least one selected from porous SUS, ceramic and gypsum. The porous layer 430 is manufactured by a template method, a replication method, a direct foaming method, etc. using ceramic or gypsum as a material, or manufactured by sintering metal powders or wires of SUS.

In another embodiment, as shown in FIG. 3B, the vacuum forming space 440 may be separated into a plurality of spaces by the partition walls 441. By separating the vacuum forming space into a plurality of spaces by the partition walls 441, when a local temperature or pressure imbalance occurs in the vacuum forming space 440, the pressure or temperature of the individual space may be independently controlled. The partition wall 441 may extend in the direction of the central axis of the inner cylinder 410 and may be formed in a plane parallel to the radial direction of the inner cylinder 410.

Each space of the vacuum forming space separated by the partition walls may be provided with a cooling flow path 442. The cooling flow path 442 may be provided for temperature correction of the outer circumferential surface of the vacuum suction roller 400.

The second heating unit 500 may heat the air permeable fabric 11 and the printing film 12. The second heating unit 500 may include an IR heater as a heat source.

The second heating unit 500 may be provided in a semi-cylindrical shape corresponding to the surface of the vacuum suction roller 400, and the inner circumferential surface of the vacuum suction roller 400 spaced apart from the outer circumferential surface by a predetermined distance.

The second heating unit 500 may be for accelerating the sublimation function of the printed sublimation transfer dye of the printing film 12, Therefore, the second heating unit 500 may be to heat the air permeable fabric 11 and the printing film 12 to 130° C. to 250° C.

The printing apparatus using the vacuum suction roller of the present invention may further comprise a cooling roller for cooling the air permeable fabric 11 by contacting one side of the roller with the air permeable fabric 11 between the vacuum suction roller 400 and the first recovery roller 700.

The dye transferred to the air permeable fabric 11 may be stabilized by the cooling roller 600 and the air permeable fabric 11 that has passed through the cooling roller 600 may be a printed product, which is recovered by the first recovery roller 700.

The printing film 12 after use may be recovered by the second recovery roller 800.

As shown in FIG. 4, the continuous printing method using the vacuum suction roller of the present invention may comprise:

a fabric preparation and preheating step (S10) of unwinding the air permeable fabric 11 from the first unwinding roller 100 and then preheating it through the first heating unit 300;

a printing film arrangement step (S20) of unwinding the printing film 12 from the second unwinding roller 200 and then laminating it on one side surface of the air permeable fabric 11;

a dyeing step (S30) using the vacuum suction roller 400 of passing the air permeable fabric 11 through the vacuum suction roller to bring the other side surface of the air permeable fabric 11 into contact with one side of the vacuum suction roller 400;

a printing film separation step (S40) of separating the printing film 12 from the air permeable fabric 11; and a dyed fabric cooling step (S50) of cooling the air permeable fabric 11 by the cooling roller 600.

In the dyeing step using the vacuum suction roller 400, the air permeable fabric 11 in close contact with the vacuum suction roller 400 may be heated by the second heating unit 500.

Although the embodiments according to the present invention have been described above, these are merely exemplary, and those of ordinary skill in the art will understand that various modifications and equivalent ranges of embodiments are possible therefrom. Accordingly, the true technical protection scope of the present invention should be defined by the following claims.

EXPLANATION OF CODE

11 . . . air permeable fabric
12 . . . printing film
13 . . . dye
100 . . . first unwinding roller
200 . . . second unwinding roller
300 . . . first heating unit
310 . . . heating means
400 . . . vacuum suction roller
500 . . . second heating unit
600 . . . cooling roller
700 . . . first recovery roller
800 . . . second recovery roller

What is claimed is:

1. A continuous sublimation transfer method using a continuous sublimation transfer apparatus employing a vacuum suction roller, the apparatus comprising:

a first unwinding roller for unwinding an air permeable fabric to be printed;

a second unwinding roller for unwinding a printing film coated with a sublimination transfer dye on one side surface;

a first heating unit for preheating the air permeable fabric unwound from the first unwinding roller;

a vacuum suction roller configured so that, while the printing film is laminated on one side surface of the air permeable fabric that has passed through the first heating unit, the other side surface of the air permeable fabric is in contact with one side of the vacuum suction roller, wherein the vacuum suction roller comprises an inner cylinder having a cylindrical shape, an outer cylinder whose inner circumferential surface is formed to be spaced apart from an outer circumferential surface of the inner cylinder, a porous layer covering the outer circumferential surface of the outer cylinder, wherein the outer circumferential surface of the inner cylinder and the inner circumferential surface of the outer cylinder are spaced apart from each other to provide a vacuum forming space, wherein the outer cylinder is provided with a plurality of suction holes, and wherein the vacuum forming space is separated into a plurality of spaces by a plurality of partition walls, and each space of the vacuum forming space separated by the partition walls is provided with a cooling flow path;

a second heating unit positioned to be spaced from the surface of the vacuum suction roller in contact with the air permeable fabric at a certain interval to heat the air permeable fabric and the printing film;

a first recovery roller for recovering the air permeable fabric that has passed through the vacuum suction roller; and a second recovery roller for recovering the printing film that passed through the vacuum suction roller, wherein the second heating unit is for accelerating the sublimation function of the sublimation transfer dye coated on the printing film, the method comprising:

a step of unwinding the air permeable fabric from the first unwinding roller and then preheating the unwound air permeable fabric through the first heating unit;

a step of unwinding the printing film from the second unwinding roller and then laminating the unwound printing film on one side surface of the air permeable fabric;

a step of passing the air permeable fabric laminated with the printing film through the vacuum suction roller to bring the exposed surface of the air permeable fabric into contact with the vacuum suction roller, wherein the air permeable fabric laminated with the printing film is heated by the second heating unit and the dye coated on the printing film is sublimated, and then the sublimated gaseous dye is guided toward the suction holes of the vacuum suction roller by the negative pressure formed inside the vacuum suction roller; and a step of separating the printing film from the air permeable fabric to obtain a dyed fabric.

2. The continuous sublimation transfer method according to claim 1, wherein the porous layer comprises an air permeable porous material having a plurality of pores, and the gas containing the sublimated dye on the surface of the vacuum roller is sucked into the vacuum forming space through the plurality of suction holes after passing through the porous layer to bring the printing film into close contact with the air permeable fabric.

3. The continuous sublimation transfer method according to claim 2, wherein the air permeable porous material is selected from porous stainless steel (SUS), ceramic and gypsum.

4. The continuous sublimation transfer method according to claim 1, wherein the air permeable fabric is a knitted fabric or a woven fabric manufactured by a weaving method.

5. The continuous sublimation transfer method according to claim 1, wherein the first heating unit is to preheat the air permeable fabric to a temperature of 100° C. to 200° C.

6. The continuous sublimation transfer method according to claim 1, wherein the material of the printing film is selected from the group consisting of polyethylene terephthalate (PET), amorphous polyethylene terephthalate (A-PET), polypropylene (PP), polyethylene (PE) and paper.

7. The continuous sublimation transfer method according to claim 1, wherein the second heating unit is to heat the air permeable fabric and the printing film to a temperature of 130° C. to 250° C.

8. The continuous sublimation transfer method according to claim 1, wherein the continuous sublimation transfer apparatus further comprises a cooling roller for cooling the air permeable fabric between the vacuum suction roller and the first recovery roller.

9. The continuous sublimation transfer method according to claim 8, further comprising a step of cooling the dyed fabric by the cooling roller.

* * * * *